US011087685B1

(12) United States Patent
Lu

(10) Patent No.: US 11,087,685 B1
(45) Date of Patent: Aug. 10, 2021

(54) FAST DATA PROGRAMMING TFT PIXEL THRESHOLD VOLTAGE COMPENSATION CIRCUIT WITH TWO PHASE THRESHOLD COMPENSATION

(71) Applicant: Sharp Kabushiki Kaisha, Osaka (JP)

(72) Inventor: Tong Lu, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 16/925,402

(22) Filed: Jul. 10, 2020

(51) Int. Cl.
*G09G 3/3233* (2016.01)

(52) U.S. Cl.
CPC ... *G09G 3/3233* (2013.01); *G09G 2300/0842* (2013.01); *G09G 2320/0233* (2013.01)

(58) Field of Classification Search
CPC ..... G09G 3/3233; G09G 2300/0842; G09G 2320/0233
See application file for complete search history.

(56) References Cited

U.S. PATENT DOCUMENTS 7,414,599 B2 8/2008 Chung et al.
9,111,492 B2 8/2015 Kim
1,006,232 A1 8/2018 Na
1,012,785 A1 11/2018 Change
1,043,115 A1 10/2019 Zhang et al.
1,049,013 A1 11/2019 Zhu et al.

*Primary Examiner* — Stacy Khoo
(74) *Attorney, Agent, or Firm* — Renner, Otto, Boisselle & Sklar, LLP

(57) ABSTRACT

A pixel circuit for a display device provides enhanced performance by performing a first threshold compensation phase that also operates to pre-charge a compensating storage capacitor, and then performing a further second threshold compensation combined with data programming during a shortened programming time. During the first threshold compensation phase, the threshold voltage of the drive transistor is stored in the compensating storage capacitor. During the combined data programming and second threshold compensation phase, the data voltage is stored in a programming capacitor, and the drive transistor threshold voltage is also stored in the programming capacitor. As the threshold voltage already is stored at the storage capacitor, and thus the node where the storage capacitor and the programming capacitor connect has been pre-charged with the threshold voltage, the pre-charging effect shortens the time needed for the programming capacitor to store the threshold voltage, which results in a short programming time while achieving high compensation accuracy.

17 Claims, 2 Drawing Sheets

FAST DATA PROGRAMMING TFT PIXEL THRESHOLD VOLTAGE COMPENSATION CIRCUIT WITH TWO PHASE THRESHOLD COMPENSATION

TECHNICAL FIELD

The present application relates to design and operation of electronic circuits for delivering electrical current to an element in a display device, such as for example to an organic light-emitting diode (OLED) in the pixel of an active matrix OLED (AMOLED) display device.

BACKGROUND ART

Organic light-emitting diodes (OLED) generate light by re-combination of electrons and holes, and emit light when a bias is applied between the anode and cathode such that an electrical current passes between them. The brightness of the light is related to the amount of the current. If there is no current, there will be no light emission, so OLED technology is a type of technology capable of absolute blacks and achieving almost "infinite" contrast ratio between pixels when used in display applications.

Several approaches are taught in the prior art for pixel thin film transistor (TFT) circuits to deliver current to an element of a display device, such as for example an organic light-emitting diode (OLED), through an n-type drive transistor. In one example, an input signal, such as a "SCAN" signal, is employed to switch transistors in the circuit to permit a data voltage, VDAT, to be stored at a storage capacitor during a programming phase. When the SCAN signal is low and the switch transistors isolate the circuit from the data voltage, the VDAT voltage is retained by the capacitor and this voltage is applied to a gate of a drive transistor. With the drive transistor having a threshold voltage $V_{TH}$, the amount of current to the OLED is related to the voltage on the gate of the drive transistor by:

$$I_{OLED} = \frac{\beta}{2}(V_{DAT} - V_{OLED} - V_{TH})^2$$

where $V_{OLED}$ is a voltage at the anode of the OLED and also the source voltage of the drive transistor.

TFT device characteristics, especially the TFT threshold voltage $V_{TH}$, may vary with time or among comparable devices, for example due to manufacturing processes or stress and aging of the TFT device over the course of operation. With the same VDAT voltage, therefore, the amount of current delivered by the drive TFT could vary by a significant amount due to such threshold voltage variations. Therefore, pixels in a display may not exhibit uniform brightness for a given VDAT value.

Conventionally, therefore, OLED pixel circuits have high tolerance ranges to variations in threshold voltage and/or carrier mobility of the drive transistor by employing circuits that compensate for mismatch in the properties of the drive transistors. For example, an approach is described in U.S. Pat. No. 7,414,599 (Chung et al., issued Aug. 19, 2008), which describes a circuit in which the drive TFT is configured to be a diode-connected device during a programming period, and a data voltage is applied to the source of the drive transistor.

The threshold compensation time is decided by the drive transistor's characteristics, which may require a long compensation time for high compensation accuracy. For the data programming time, the RC constant time required for charging the programming capacitor is determinative of the programming time. As is denoted in the art, the one horizontal (1H) time is the time that it takes for the data to be programmed for one row.

With such circuit configuration as in U.S. Pat. No. 7,414,599, the data is programmed at the same time as when the threshold voltage of the drive transistor is compensated. It is desirable, however, to have as short of a one horizontal time as possible to enhance the responsiveness and operation of the display device. This is because each row must be programmed independently, whereas other operations, such as for example drive transistor compensation, may be performed for multiple rows simultaneously. The responsiveness of the display device, therefore, tends to be dictated most by the one horizontal time for programming. When the data is programmed during the same operational phase that the drive transistor is compensated, the one horizontal time cannot be reduced further due to compensation accuracy requirements for the drive transistor, as the compensation requirements limit any time reductions for the programming phase.

Another approach is described in U.S. Pat. No. 9,111,492 (Hyund-Soo Kim, issued Aug. 18, 2015). In such circuit, a current data signal is used to obtain the threshold compensation voltage. Then a second voltage data signal is used to program the data. In this way, the one horizontal time is dictated by the data programming time only, but by using a current data signal rather than a voltage level, the system may take significant time to settle. As a result, the threshold compensation time could be much longer than otherwise is required for a voltage based mode. Another disadvantage is that the current data scheme may be difficult to implement as compared to voltage based compensation.

Another approach is described in U.S. Ser. No. 10/431,156 (Kai Zhang, issued Oct. 1, 2019). The data voltage and threshold voltage are first programmed to one capacitor. During emission, a PWM (pulse width modulation) approach is used to adjust the OLED current. Because the data programming and threshold compensation are applied to one capacitance and happen at the same time, this scheme is not suitable for fast programming because the programming time cannot be significantly shortened.

U.S. Ser. No. 10/490,136 (Renyuan Zhu, issued Nov. 26, 2019) describes a circuit operation with data voltage programming that happens at the same time as threshold compensation. The data voltage and threshold compensation voltage are stored at one capacitor, and the circuit has a second capacitor to hold such voltage during emission. Similarly with the above approach, because the data programming and threshold compensation are applied to one capacitance and happen at the same time, this configuration is not suitable for fast programming because the programming time cannot be significantly shortened.

U.S. Ser. No. 10/062,321 (Ji-su Na, issued Aug. 28, 2018) describes a circuit operation applying a reference voltage to the gate of the drive transistor for threshold compensation and then applying data to the gate of the drive transistor for data programming. A short 1H time can be achieved, but such operation experiences detrimental effects of noise from the data line which can affect the output during the emission phase.

U.S. Ser. No. 10/127,859 (Sangwook Change, issued Nov. 13, 2018) describes a circuit operation similarly applying a reference voltage to the gate of the drive transistor for threshold compensation and then applying data to the gate of the drive transistor for data programming. A short 1H time can be achieved, but the described circuit configuration uses double gates for the data line and reference voltage line for isolation. Data noise isolation performance remains deficient, and thus such noise still can affect the output during the emission phase.

SUMMARY OF INVENTION

The present application relates to pixel circuits that are capable of compensating the threshold voltage variations of the drive transistor with an ultra-short one horizontal time 1H of less than about 2 μs, which is shorter as compared to conventional configurations. Embodiments of the present application provide pixel circuits for high refresh rate requirements, such as for 120 Hz applications. For such applications, an ultra-short 1H time (<2 μs) is achieved with accurate threshold compensation of the drive transistor by employing a first threshold compensation phase that also operates to pre-charge the compensating storage capacitor, and then performing a further second threshold compensation combined with data programming during a shortened 1H time.

Accordingly, the circuit configuration is operated in a relatively prolonged duration first threshold compensation phase for pre-charging the compensating storage capacitor, and in a relatively short duration combined data programming and second threshold compensation phase to program the data and store the threshold voltage to a programming capacitor. As referenced above, the threshold compensation time is dictated by the drive transistor characteristics and is difficult to reduce further without degrading the compensation accuracy. On the other hand, a short programming time (1H time) is desirable because overall circuit responsiveness tends to be dictated most by the programming time. To balance these considerations, during the first threshold compensation phase the threshold voltage of the drive transistor is stored in the compensating storage capacitor. During the combined data programming and second threshold compensation phase, the data voltage is stored in the programming capacitor, and the drive transistor threshold voltage is also stored in the programming capacitor. As the threshold voltage already is stored at the storage capacitor, and thus the node where the storage capacitor and the programming capacitor connect has been pre-charged with the threshold voltage, the pre-charging effect shortens the time needed for the programming capacitor to store the threshold voltage. By performing a threshold compensation operation that pre-charges the storage capacitor independent of data programming, and performing further threshold compensation combined with the data programming, programming time still can be reduced to ultra-short 1H times (<2 μs) while ensuring that the threshold compensation can achieve the required accuracy.

An aspect of the invention, therefore, is a pixel circuit for a display device that provides enhanced performance by performing a threshold compensation during a first threshold compensation phase and performing further threshold compensation combined with data programming to achieve a short programming time while ensuring threshold compensation accuracy. In exemplary embodiments, the pixel circuit is operable in an initialization phase, a first threshold compensation phase, a combined data programming and second threshold compensation phase, and an emission phase, the pixel circuit including: a drive transistor configured to control an amount of current to a light-emitting device during the emission phase depending upon a voltage applied to a gate of the drive transistor, the drive transistor having a first terminal and a second terminal with the first terminal being connected to a first voltage supply line; a programming capacitor having a first plate connected to the second terminal of the drive transistor, and a second plate that is electrically connected to the gate of the drive transistor during the initialization phase and the emission phase, wherein the programming capacitor stores a data voltage and a threshold voltage of the drive transistor during the combined data programming and second threshold compensation phase; a storage capacitor having a first plate connected to the second terminal of the drive transistor and a second plate connected to the gate of the drive transistor, wherein the storage capacitor stores the threshold voltage of the drive transistor during the first threshold compensation phase and the stored threshold voltage pre-charges the storage capacitor for the second threshold compensation phase; a light-emitting device having a first terminal that is electrically connected the second terminal of the drive transistor during the emission phase, and a second terminal connected to a second voltage supply line; and a first switch transistor connected between the gate of the drive transistor and the first voltage supply line, wherein the first switch transistor is placed in an on state during the initialization phase, the first threshold compensation phase, and the combined data programming and second threshold compensation phase to electrically connect the gate and the first terminal of the drive transistor for threshold compensation of the threshold voltage of the drive transistor.

In exemplary embodiments, the pixel circuit further includes a second switch transistor connected between the gate of the drive transistor and the second plate of the programming capacitor, wherein the second switch transistor is placed in an on state to electrically connected the second plate of the programming capacitor to the gate of the drive transistor; a third switch transistor connected between the second plate of the programming capacitor and a data voltage supply line that supplies the data voltage, wherein the third switch transistor is placed in an on state during the combined data programming and second threshold compensation phase to apply the date voltage to the second plate of the programming capacitor; a fourth switch transistor connected between an initialization voltage supply line that supplies an initialization voltage and the first terminal of the light emitting device, wherein the fourth switch transistor is placed in an on state to apply the initialization voltage to the first terminal of the light-emitting device and to a node N1 corresponding to a connection of the second terminal of the drive transistor, the first plate of the programming capacitor, and the first plate of the storage capacitor; and/or a fifth switch transistor that is connected between the node N1 and the first terminal of the light-emitting device, wherein the fifth transistor is placed in an on state to electrically connect the first terminal of the light-emitting device to the node N1.

Another aspect of the invention is a method of operating a pixel circuit in a manner that provides a short programming time combined with high threshold compensation accuracy. In exemplary embodiments, the method of operating includes the steps of providing a pixel circuit in accordance with any of the embodiments; performing a first threshold compensation phase to compensate the threshold voltage of the drive transistor comprising: placing the first switch transistor in an on state, thereby diode connecting the drive transistor by electrically connecting the gate and the first terminal of the drive transistor through the first switch transistor; and electrically disconnecting the second terminal of the drive transistor from the first terminal of the light-emitting device; wherein the threshold voltage of the drive transistor is stored at the storage capacitor and pre-charges the storage capacitor; performing a combined data programming and second threshold compensation phase to program data and further compensate the threshold voltage of the drive transistor comprising: electrically connecting the second plate of the programming capacitor to a data voltage supply line that supplies a data voltage, wherein the date voltage is applied to the second plate of the programming capacitor to store the data voltage; and storing the threshold voltage at the first plate of the programming capacitor while maintaining the first switch transistor in the on state to further perform threshold compensation of the threshold voltage of the drive transistor; and performing an emission phase during which light is emitted from the light-emitting device comprising electrically connecting the first terminal of the light-emitting device to the second terminal of the drive transistor and applying a driving voltage from the first voltage supply line to the light-emitting device through the drive transistor.

In exemplary embodiments, the method of operating further includes performing an initialization phase to initialize voltages within the pixel circuit comprising the steps of: electrically connecting the first terminal of the light-emitting device to an initialization voltage supply line that supplies an initialization voltage to initialize a voltage of the light-emitting device; and electrically connecting the initialization voltage supply line to a node N1 corresponding to a connection of the first terminal of the drive transistor, the first plate of the programming capacitor, and the first plate of the storage capacitor, thereby applying the initialization voltage to the node N1 to initialize a gate voltage of the drive transistor and voltages across the programming capacitor and the storage capacitor. The initialization phase further may include placing the first switch transistor in the on state to diode connect the drive transistor to electrically connect the gate of the drive transistor to the first voltage supply line through the first switch transistor.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DESCRIPTION OF EMBODIMENTS

Figure 1:
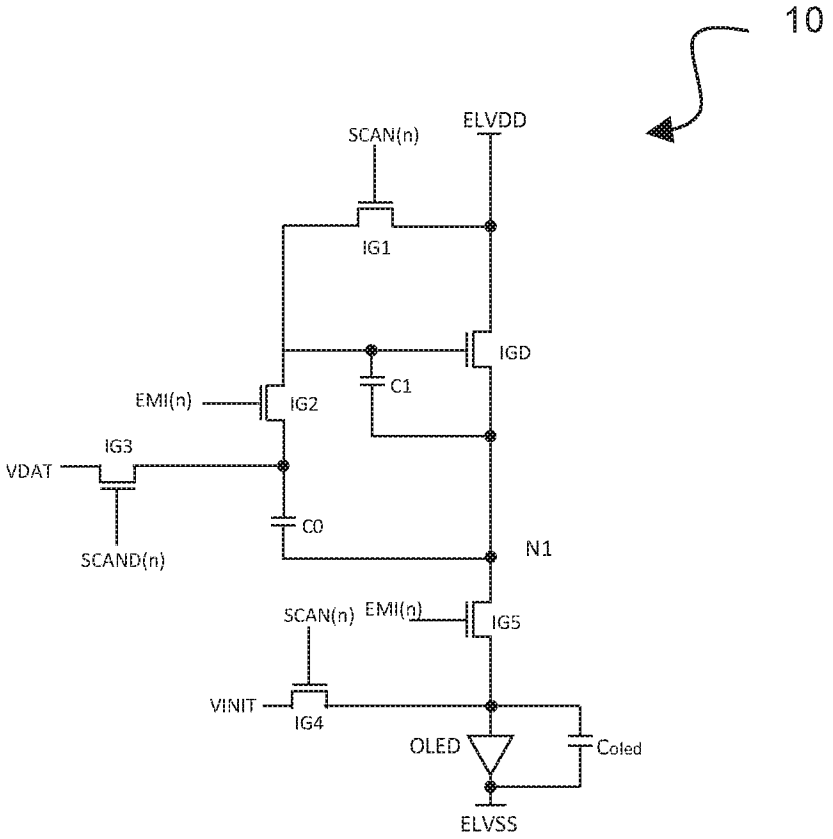
FIG. 1 is a drawing depicting a circuit configuration in accordance with embodiments of the present application.

Embodiments of the present application will now be described with reference to the drawings, wherein like reference numerals are used to refer to like elements throughout. It will be understood that the figures are not necessarily to scale.

Figure 2:
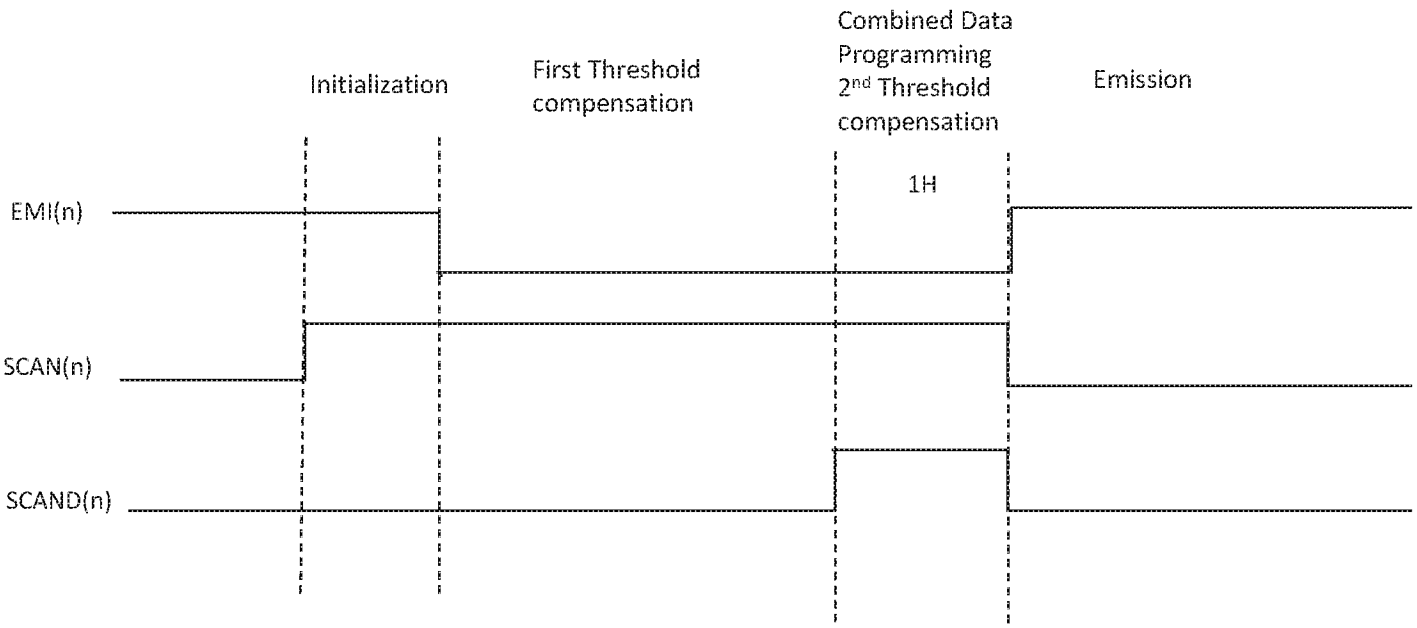
FIG. 2 is a drawing depicting a timing diagram associated with the operation of the circuit of FIG. 1.

FIG. 1 is a drawing depicting a circuit configuration 10 in accordance with embodiments of the present application, and FIG. 2 is a timing diagram associated with the operation of the circuit configuration 10 of FIG. 1. In this example, the circuit 10 is configured as a thin film transistor (TFT) circuit that includes multiple n-type transistors IGD, IG1, IG2, IG3, IG4, and IG5, and two capacitors C0 and C1. The circuit elements drive a light-emitting device, such as for example an OLED. The light-emitting device (OLED) has an associated internal capacitance, which is represented in the circuit diagram as $C_{oled}$. In addition, although the embodiments are described principally in connection with an OLED as the light-emitting device, comparable principles may be used with display technologies that employ other types of light-emitting devices, including for example micro LEDs and quantum dot LEDs.

More specifically, FIG. 1 depicts the TFT circuit 10 configured with multiple n-type TFTs. IGD is a drive transistor that is an analogue TFT, and IG2-IG5 are digital switch TFTs. As referenced above, C0 and C1 are capacitors, with C0 also being referred to as the programming capacitor and C1 also being referred to as the storage capacitor. Coley is the internal capacitance of the OLED device (i.e., $C_{oled}$ is not a separate component, but is inherent to the OLED). The OLED further is connected to a power supply line that provides a power supply ELVSS as is conventional.

The OLED and the TFT circuit 10, including the transistors, capacitors and connecting wires, may be fabricated using TFT fabrication processes conventional in the art. It will be appreciated that comparable fabrication processes may be employed to fabricate the TFT circuits according to any of the embodiments.

For example, the TFT circuit 10 (and subsequent embodiments) may be disposed on a substrate such as a glass, plastic, or metal substrate. Each TFT may comprise a gate electrode, a gate insulating layer, a semiconducting layer, a first electrode, and a second electrode. The semiconducting layer is disposed on the substrate. The gate insulating layer is disposed on the semiconducting layer, and the gate electrode may be disposed on the insulating layer. The first electrode and second electrode may be disposed on the insulating layer and connected to the semiconducting layer using vias. The first electrode and second electrode respectively may commonly be referred to as the "source electrode" and "drain electrode" of the TFT. The capacitors each may comprise a first electrode, an insulating layer and a second electrode, whereby the insulating layer forms an insulating barrier between the first and second electrodes. Wiring between components in the circuit, and wiring used to introduce signals to the circuit (e.g. SCAN, SCAND, EMI, VDAT, VINIT) may comprise metal lines or a doped semiconductor material. For example, metal lines may be disposed between the substrate and the gate electrode of a TFT, and connected to electrodes using vias. The semiconductor layer may be deposited by chemical vapour deposition, and metal layers may be deposited by a thermal evaporation technique.

The OLED device may be disposed over the TFT circuit. The OLED device may comprise a first terminal (e.g. anode of the OLED), which is connected to transistors IG4 and IG5 in this example, one or more layers for injecting or transporting charge (e.g. holes) to an emission layer, an emission layer, one or more layers for injecting or transporting electrical charge (e.g. electrons) to the emission layer, and a second terminal (e.g. cathode of the OLED), which is connected to power supply line ELVSS in this example. The injection layers, transport layers and emission layer may be organic materials, the first and second electrodes may be metals, and all of these layers may be deposited by a thermal evaporation technique.

Embodiments of the present application may use an ultra-low leakage oxide transistor, such as an indium gallium zinc oxide (IGZO) transistor (denoted by "IG" in FIG. 1 as to the transistors) as the data switch device and other switch transistors, and this permits the stored data voltage to be retained longer on the programming capacitor due to the ultra-low leakage of the ultra-low leakage transistor. As a result, the refresh rate can be reduced as compared to conventional configurations, down to about 30 Hz which is particularly suitable for displaying static images. Embodiments of the present application can also use low-temperature polycrystalline silicon thin film transistor processes (LTPS) for better mobility for the drive transistor.

Referring to the TFT circuit 10 of FIG. 1 in combination with the timing diagram of FIG. 2, the TFT circuit 10 operates to perform in four phases: an initialization phase, a first threshold compensation phase, a combined data programming and second threshold compensation phase, and an emission phase for light emission. The time period for performing the programming phase is referred to in the art as the "one horizontal time" or "1H" time as illustrated in the timing diagram. A short 1H time is a requirement for displays with a large number of pixels in a column, as is necessary for high-resolution displays and for high refresh rates such as used for 120 Hz applications. As referenced above, a short one horizontal time is significant because each row must be programmed independently, whereas other operations, such as for example drive transistor threshold compensation, may be performed for multiple rows simultaneously. The responsiveness of the device, therefore, tends to be dictated most by the one horizontal time for programming.

Generally, this embodiment has comparable control signals EMI and SCAN for other rows of pixels in the overall or broader display device, thereby enabling fewer control signal wires in a display configuration as common control lines may be shared over different rows. For this example and in subsequent embodiments, display pixels are addressed by row and column. The current row is row n. The previous row is row n−1, and the second previous row is n−2. The next row is row n+1, and the row after that is row n+2, and so on for the various rows as they relate to the corresponding control signals identified in the figures. Accordingly, for example, SCAN(n) refers to the scan signal at row n and SCAN(n+1) refers to the scan signal at row n+1, and the like. EMI(n) refers to the emission signal at row n and EMI(n−1) refers to the emission signal at row n−1, and the like, and so on for the various control signals. In this manner, for the various embodiments the input signals correspond to the indicated rows.

As illustrated in the timing diagram of FIG. 2, in this embodiment, during the previous emission phase, the EMI (n) signal level has a high voltage value, so transistors IG2 and IG5 are in an on state, and light emission is being driven by the input driving voltage ELVDD connected by a power supply line to the drive transistor IGD, whereby the actual current applied to the OLED is determined by the voltage at the gate and the source of the drive transistor. The SCAN(n) signal level for the applicable rows initially has a low voltage value so transistors IG1 and IG4 are in an off state. The SCAND(n) signal level for the applicable rows initially has a low voltage value, so transistor IG3 is in an off state.

At the beginning of the initialization phase, the SCAN(n) signal level is changed from a low voltage value to a high voltage value, causing transistors IG1 and IG4 to be placed in the on state. Switch transistor IG1 has a first terminal connected to a first terminal of the drive transistor, and a second terminal connected to the gate of the drive transistor. As transistor IG1 is turned on, the power supply line that supplies ELVDD becomes electrically connected to the gate of the drive transistor through IG1, and thus the driving power supply ELVDD is applied to the gate of the drive transistor. By physical connection, ELVDD also is applied to the first terminal or drain of the drive transistor, and thus the gate and first terminal/drain of the drive transistor are electrically connected through IG1. The drive transistor is therefore referred to as being "diode-connected". Diode-connected refers to the drive transistor IGD being operated with its gate and a second terminal (e.g., source or drain) being electrically connected, such that current flows in one direction.

Switch transistor IG4 is connected with a first terminal connected to an initialization voltage supply line that supplies an initialization voltage VINIT, and a second terminal connected to a first terminal (anode) of the light-emitting device. As transistor IG4 is turned on, the first terminal of the light-emitting device is electrically connected to the initialization supply line through IG4, and thus the initialization voltage VINIT is applied to the first terminal (anode) of the OLED through IG4. The VINIT voltage level is set lower than the threshold voltage of the OLED plus the lower power supply ELVSS applied from another power supply line to a second terminal (cathode) of the OLED, so that there is no light emission. With IG5 also remaining in the on state from the previous emission phase, the initialization voltage supply line is electrically connected to a node N1 corresponding to a connection of first (bottom) plates of the capacitors C0 and C1 and a second terminal (source) of the drive transistor IGD. In this manner, a voltage at the gate of the drive transistor, and voltages across the capacitors C0 and C1, are initialized during the initialization phase. The initialization phase thereby operates to eliminate memory effects from previous frames.

The TFT circuit 10 next is operable in a first threshold compensation phase, during which the threshold voltage of the drive transistor IGD is compensated and stored in the storage capacitor C1. Capacitor C1 has its first (bottom) plate connected to the node N1 and its second (top) plate connected to the gate of the drive transistor. As referenced above, switch transistor IG1 has a first terminal connected to the first terminal of the drive transistor, and a second terminal connected to the gate of the drive transistor. At the beginning of this phase, the EMI(n) signal level is changed from a high voltage value to a low voltage value, causing transistors IG2 and IG5 to be placed in the off state. As the transistor IG2 is turned off, the second (top) plate of the programming capacitor C0 and the gate of the drive transistor are electrically disconnected from each other. As the transistor IG5 is turned off, the anode of OLED is electrically disconnected from the second terminal or source of the drive transistor, and from the first (bottom) plate of each of the capacitors C1 and the C0 (also denoted collectively as the node N1), which electrically isolates the light-emitting device from the capacitors and drive transistor. The second terminal or the source of the drive transistor is floating as a result of transistor IG5 being turned off.

As the diode-connected drive transistor is electrically connected to the ELVDD supply line, the source voltage of the drive transistor will be pulled up from initialization voltage VINIT towards $V_{ELVDD}-|V_{TH}|$, where $V_{TH}$ is the threshold voltage of the drive transistor. Preferably, to have effective threshold voltage compensation of the drive transistor IGD, the initial voltage difference between the source of the drive transistor and the diode-connected gate-drain of the drive transistor should satisfy the following condition:

$$V_{ELVDD}-V_{INIT}>|V_{TH}|+\Delta V.$$

where ΔV is a voltage that is large enough to generate a high initial current to charge the storage capacitor C1 within an allocated threshold compensation time. The value of ΔV will depend on the properties of the transistors. For example, ΔV would be at least 3 volts for exemplary low-temperature polycrystalline silicon thin film transistor processes or indium gallium zinc oxide thin film transistor processes. The initialization voltage, VINIT, is set to satisfy this voltage requirement.

At the end of the first threshold compensation phase, the threshold voltage of the drive transistor IGD, $|V_{TH}|$, is stored at storage capacitor C1, which is connected between the gate and source of the drive transistor. As the second (top) plate of the programming capacitor C0 is floating, there is no charge change in the programming capacitor C0.

The TFT circuit 10 next is operable in a combined data programming and second threshold compensation phase, wherein the data voltage is programmed to the programming capacitor C0. During this phase, the threshold voltage of the drive transistor also is stored to the programming capacitor C0, and the threshold voltage is maintained in the storage capacitor C1. Transistor IG3 has a first terminal connected to a data voltage supply line that supplies the data voltage VDAT, and a second terminal connected to the second (top) plate of the programming capacitor C0. At the beginning of the combined data programming and second threshold compensation phase, the SCAND(n) signal level is changed from a low voltage value to high voltage value, causing transistor IG3 to be placed in an on state. As the transistor IG3 is turned on, the second plate of the programming capacitor C0 is electrically connected to the data voltage supply line, and the data voltage VDAT thus is applied to the second plate of the programming capacitor C0. The data voltage VDAT is changed from the value for another pixel (e.g. the previous row of the display DATA(n−1)) to the data value for the current pixel (e.g. the current row of the display DATA(n)), which is applied to the programming capacitor C0.

At the end of the initialization phase described above, the voltage at the second plate of the programming capacitor C0 is ELVDD (through on transistors IG1 and IG2) and the voltage at the second plate of the storage capacitor C1 is also ELVDD (through on transistor IG1). The voltage at the first plate of the programming capacitor C0 is VINIT, which is also the node N1 at which the first plate of the storage capacitor C1 and the source of the drive transistor also are connected.

In addition, at the end of the first threshold compensation phase described above, the voltage at the node N1 (again where the first plate of the storage capacitor C1, the first plate of the programming capacitor C0, and the source of the drive transistor are connected), becomes $V_{ELVDD}-|V_{TH}|$. The voltage change at the node N1, also the first plate of the storage capacitor C1 and the first plate of programming capacitor C0. therefore is $V_{ELVDD}-|V_{TH}|-V_{INIT}$.

As the second plate of the programming capacitor C0 is floating, the voltage at such second plate will follow the voltage change at the first plate. The voltage at the second plate of the programming capacitor C0 thus becomes $2V_{ELVDD}-|V_{TH}|-V_{INIT}$.

The above corresponds to the voltage states at the end of the first threshold compensation phase (also the beginning of the combined data programming and second threshold compensation phase). When the data voltage is applied to the second plate of the programming capacitor C0 during the combined data programming and second threshold compensation phase, the voltage change at such second plate is $V_{DATA}-(2V_{ELVDD}-|V_{TH}|-V_{INIT})$. The voltage change at the second plate will cause a voltage change at the first plate by an amount of:

$$\frac{(V_{DATA}-(2V_{ELVDD}-|V_{TH}|-V_{INIT}))C_0}{C_1+C_0}.$$

The voltage at the first plate of the programming capacitor thus becomes:

$$V_{ELVDD}-|V_{TH}|+\frac{(V_{DATA}-(2V_{ELVDD}-|V_{TH}|-V_{INIT}))C_0}{C_1+C_0}=\frac{V_{ELVDD}(C_1-C_0)+(V_{DATA}+V_{INIT})C_0}{C_0+C_1}-\frac{|V_{TH}|C_0}{C_0+C_1}$$

The above voltage of the first plate of the programming capacitor is the starting point of the second threshold compensation portion of the drive transistor. At the end of this phase, the voltage at the first plate of the programming capacitor will return to $V_{ELVDD}-|V_{TH}|$. As the starting voltage already has a portion of the threshold voltage $$\frac{|V_{TH}|C_0}{C_0+C_1},$$

it taxes a snorter time to fully compensate the threshold voltage, and thus this shorter time needed to complete threshold compensation during the combined data programming and second threshold compensation phase permits fast programming at the same time as the completion of threshold compensation. Accordingly, the storage capacitor stores the threshold voltage of the drive transistor during the first threshold compensation phase, and the stored threshold voltage pre-charges the storage capacitor for the second threshold compensation phase. This permits minimizing the time required for the second threshold compensation phase, and as the second threshold compensation phase is combined with data programming, the data programming 1H time in turn is minimized to permit fast data programming.

The TFT circuit 10 next is operable in an emission phase during which the OLED is capable of emitting light. The EMI(n) signal is changed from the low voltage value to the high voltage value, causing transistors IG2 and IG5 to be placed in the on state. As transistor IG2 is turned on, the gate of the drive transistor and the second (top) plate of the storage capacitor C1 are electrically connected to the second (top) plate of the programming capacitor C0. The charge on both capacitors is redistributed between the two capacitors as follows.

The charge on the capacitor C0 before IG2 is turned on is:

$$Q_{C0}=(V_{DATA}-(V_{ELVDD}-|V_{TH}|))C_0$$

The charge on the capacitor C1 before IG2 is turned on is:

$$Q_{C1}=|V_{TH}|C_1$$

The total charge after the IG2 is turned on is:

$$Q = Q_{C0} + Q_{C1} = (V_{DATA} - (V_{ELVDD} - |V_{TH}|))C_0 + |V_{TH}|C_1 = (V_{DATA} - V_{ELVDD})C_0 + |V_{TH}|(C_0 + C_1)$$

The voltage across the capacitors C0 and C1, which also is the voltage across the gate and source $V_{GS}$ of the drive transistor IGD, is:

$$V_{GS} = \frac{Q}{C_0 + C_1} = \frac{(V_{DATA} - V_{ELVDD})C_0}{C_0 + C_1} + |V_{TH}|$$

As transistor IG5 is turned on, the source of the drive transistor also is electrically connected to the anode of the OLED. The current that flows through the OLED is:

$$I_{OLED} = \frac{\beta}{2}(V_{GS} - |V_{TH}|)^2 = \frac{\beta}{2}\left(\frac{(V_{DATA} - V_{ELVDD})C_0}{C_0 + C_1}\right)^2$$

where $$\beta = \mu_n \cdot C_{ox} \cdot \frac{W}{L},$$

$C_{ox}$ is the capacitance of the drive transistor gate oxide;
W is the width of the drive transistor channel;
L is the length of the drive transistor channel (i.e. distance between source and drain); and
$\mu_n$ is the carrier mobility of the drive transistor.

Accordingly, the current to the OLED does not depend on the threshold voltage of the drive transistor IGD, and thus the threshold voltage of the drive transistor is compensated.

The pixel circuit embodiments of the current application have advantages over conventional configurations. The circuit configurations are suitable for high refresh rate requirements, such as for 120 Hz applications. For such applications, an ultra-short 1H time (<2 μs) is achieved with accurate threshold compensation of the drive transistor by employing a first threshold compensation phase that also operates to pre-charge the compensating storage capacitor C1, and then performing further threshold compensation combined with data programming during a shortened 1H time (the referenced combined data programming and second threshold compensation phase). As described above, the circuit configuration is operated in a relatively prolonged duration first threshold compensation phase for pre-charging the compensating storage capacitor, and in a relatively short duration combined data programming and second threshold compensation phase to program the data and store the threshold voltage to the programming capacitor.

As referenced above, the threshold compensation time is dictated by the drive transistor characteristics and is difficult to reduce further without degrading the compensation accuracy. On the other hand, a short programming time (1H time) is desirable because overall circuit responsiveness tends to be dictated most by the programming time. To balance these considerations, during the first threshold compensation phase the threshold voltage of the drive transistor is stored in the compensating storage capacitor C1 by the pre-charging operation. During the combined data programming and second threshold compensation phase, the data voltage is stored in the programming capacitor, and the drive transistor threshold voltage also is stored in the programming capacitor. As the threshold voltage already is stored at the storage capacitor, and thus the node N1 where the storage capacitor and the programming capacitor connect has been pre-charged with the threshold voltage, the pre-charging effect shortens the time needed for the programming capacitor to store the threshold voltage. By performing a threshold compensation operation that pre-charges the storage capacitor independent of data programming during a first phase, and performing further threshold compensation and data programming in the combined second phase, programming time still can be reduced to ultra-short 1H times (<2 μs) while ensuring that the threshold compensation can achieve the required accuracy.

An aspect of the invention, therefore, is a pixel circuit for a display device that provides enhanced performance by performing a threshold compensation during a first threshold compensation phase and performing further threshold compensation combined with data programming to achieve a short programming time while ensuring threshold compensation accuracy. In exemplary embodiments, the pixel circuit is operable in an initialization phase, a first threshold compensation phase, a combined data programming and second threshold compensation phase, and an emission phase. The pixel circuit includes a drive transistor configured to control an amount of current to a light-emitting device during the emission phase depending upon a voltage applied to a gate of the drive transistor, the drive transistor having a first terminal and a second terminal with the first terminal being connected to a first voltage supply line; a programming capacitor having a first plate connected to the second terminal of the drive transistor, and a second plate that is electrically connected to the gate of the drive transistor during the initialization phase and the emission phase, wherein the programming capacitor stores a data voltage and a threshold voltage of the drive transistor during the combined data programming and second threshold compensation phase; a storage capacitor having a first plate connected to the second terminal of the drive transistor and a second plate connected to the gate of the drive transistor, wherein the storage capacitor stores the threshold voltage of the drive transistor during the first threshold compensation phase and the stored threshold voltage pre-charges the storage capacitor for the second threshold compensation phase; a light-emitting device having a first terminal that is electrically connected the second terminal of the drive transistor during the emission phase, and a second terminal connected to a second voltage supply line; and a first switch transistor connected between the gate of the drive transistor and the first voltage supply line, wherein the first switch transistor is placed in an on state during the initialization phase, the first threshold compensation phase, and the combined data programming and second threshold compensation phase to electrically connect the gate and the first terminal of the drive transistor for threshold compensation of the threshold voltage of the drive transistor. The pixel circuit may include one or more of the following features, either individually or in combination.

In an exemplary embodiment of the pixel circuit, the pixel circuit further includes a second switch transistor connected between the gate of the drive transistor and the second plate of the programming capacitor, wherein the second switch transistor is placed in an on state to electrically connected the second plate of the programming capacitor to the gate of the drive transistor.

In an exemplary embodiment of the pixel circuit, the pixel circuit further includes a third switch transistor connected between the second plate of the programming capacitor and a data voltage supply line that supplies the data voltage, wherein the third switch transistor is placed in an on state during the combined data programming and second threshold compensation phase to apply the date voltage to the second plate of the programming capacitor.

In an exemplary embodiment of the pixel circuit, the pixel circuit further includes a fourth switch transistor connected between an initialization voltage supply line that supplies an initialization voltage and the first terminal of the light emitting device, wherein the fourth switch transistor is placed in an on state to apply the initialization voltage to the first terminal of the light-emitting device and to a node N1 corresponding to a connection of the second terminal of the drive transistor, the first plate of the programming capacitor, and the first plate of the storage capacitor.

In an exemplary embodiment of the pixel circuit, the pixel circuit further includes a fifth switch transistor that is connected between the node N1 and the first terminal of the light-emitting device, wherein the fifth transistor is placed in an on state to electrically connect the first terminal of the light-emitting device to the node N1.

In an exemplary embodiment of the pixel circuit, at least one of the transistors is an indium gallium zinc oxide (IGZO) transistor.

In an exemplary embodiment of the pixel circuit, the light-emitting device is one of an organic light-emitting diode, a micro light-emitting diode (LED), or a quantum dot LED.

Another aspect of the invention is a method of operating a pixel circuit in a manner that provides a short programming time combined with high threshold compensation accuracy. In exemplary embodiments, the method of operating includes the steps of providing a pixel circuit in accordance with any of the embodiments; performing a first threshold compensation phase to compensate the threshold voltage of the drive transistor comprising: placing the first switch transistor in an on state, thereby diode connecting the drive transistor by electrically connecting the gate and the first terminal of the drive transistor through the first switch transistor; and electrically disconnecting the second terminal of the drive transistor from the first terminal of the light-emitting device; wherein the threshold voltage of the drive transistor is stored at the storage capacitor and pre-charges the storage capacitor; performing a combined data programming and second threshold compensation phase to program data and further compensate the threshold voltage of the drive transistor comprising: electrically connecting the second plate of the programming capacitor to a data voltage supply line that supplies a data voltage, wherein the date voltage is applied to the second plate of the programming capacitor to store the data voltage; and storing the threshold voltage at the first plate of the programming capacitor while maintaining the first switch transistor in the on state to further perform threshold compensation of the threshold voltage of the drive transistor; and performing an emission phase during which light is emitted from the light-emitting device comprising electrically connecting the first terminal of the light-emitting device to the second terminal of the drive transistor and applying a driving voltage from the first voltage supply line to the light-emitting device through the drive transistor. The method of operating may include one or more of the following features, either individually or in combination.

In an exemplary embodiment of the method of operating, the emission phase further comprises placing the second switch transistor in an on state to electrically connect the second plate of the programming capacitor to the gate of the drive transistor through the second switch transistor.

In an exemplary embodiment of the method of operating, the combined data programming and second threshold compensation phase further comprises placing the third switch transistor in an on state to apply the date voltage to the second plate of the programming capacitor through the third switch transistor.

In an exemplary embodiment of the method of operating, the method further includes performing an initialization phase to initialize voltages within the pixel circuit comprising the steps of: electrically connecting the first terminal of the light-emitting device to an initialization voltage supply line that supplies an initialization voltage to initialize a voltage of the light-emitting device; and electrically connecting the initialization voltage supply line to a node N1 corresponding to a connection of the first terminal of the drive transistor, the first plate of the programming capacitor, and the first plate of the storage capacitor, thereby applying the initialization voltage to the node N1 to initialize a gate voltage of the drive transistor and voltages across the programming capacitor and the storage capacitor.

In an exemplary embodiment of the method of operating, the initialization phase further comprises placing the first switch transistor in the on state to diode connect the drive transistor to electrically connect the gate of the drive transistor to the first voltage supply line through the first switch transistor.

In an exemplary embodiment of the method of operating, each of the initialization phase, the first threshold compensation phase, and the combined data programming and second threshold compensation phase further comprises placing the fourth switch transistor in an on state to apply the initialization voltage to the first terminal of the light-emitting device through the fourth switch transistor.

In an exemplary embodiment of the method of operating, the initialization phase further comprises placing the fifth transistor in an on state to electrically connect the node N1 to the initialization voltage supply line through the fourth and fifth switch transistors.

In an exemplary embodiment of the method of operating, the emission phase further comprises placing the fifth switch transistor in an on state to electrically connect the first terminal of the light-emitting device to the second terminal of the drive transistor.

In an exemplary embodiment of the method of operating, at least one of the transistors is an indium gallium zinc oxide (IGZO) transistor.

In an exemplary embodiment of the method of operating, the light-emitting device is one of an organic light-emitting diode, a micro light-emitting diode (LED), or a quantum dot LED Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

INDUSTRIAL APPLICABILITY

Embodiments of the present application are applicable to many display devices to permit display devices of high resolution with effective threshold voltage compensation and true black performance. Examples of such devices include televisions, mobile phones, personal digital assistants (PDAs), tablet and laptop computers, desktop monitors, digital cameras, and like devices for which a high resolution display is desirable.

REFERENCE SIGNS LIST

10—circuit configuration
IGD—drive transistor
IG1-IG5—multiple switch transistors
OLED—organic light emitting diode (or generally light-emitting device)
C0—programming capacitor
C1—storage capacitor
$C_{oled}$—internal capacitance of OLED
N1—Node in the pixel circuit
VDAT—data voltage provided on data voltage supply line
ELVSS—light-emitting device power supply provided on power supply line
ELVDD—driving voltage power supply provided on power supply line
SCAN/SCAND/EMI—control signals

What is claimed is:

1. A pixel circuit for a display device operable in an initialization phase, a first threshold compensation phase, a combined data programming and second threshold compensation phase, and an emission phase, the pixel circuit comprising:

a drive transistor configured to control an amount of current to a light-emitting device during the emission phase depending upon a voltage applied to a gate of the drive transistor, the drive transistor having a first terminal and a second terminal with the first terminal being connected to a first voltage supply line;

a programming capacitor having a first plate connected to the second terminal of the drive transistor, and a second plate that is electrically connected to the gate of the drive transistor during the initialization phase and the emission phase, wherein the programming capacitor stores a data voltage and a threshold voltage of the drive transistor during the combined data programming and second threshold compensation phase;

a storage capacitor having a first plate connected to the second terminal of the drive transistor and a second plate connected to the gate of the drive transistor, wherein the storage capacitor stores the threshold voltage of the drive transistor during the first threshold compensation phase and the stored threshold voltage pre-charges the storage capacitor for the second threshold compensation phase;

a light-emitting device having a first terminal that is electrically connected the second terminal of the drive transistor during the emission phase, and a second terminal connected to a second voltage supply line; and a first switch transistor connected between the gate of the drive transistor and the first voltage supply line, wherein the first switch transistor is placed in an on state during the initialization phase, the first threshold compensation phase, and the combined data programming and second threshold compensation phase to electrically connect the gate and the first terminal of the drive transistor for threshold compensation of the threshold voltage of the drive transistor.

2. The pixel circuit of claim 1, further comprising a second switch transistor connected between the gate of the drive transistor and the second plate of the programming capacitor, wherein the second switch transistor is placed in an on state to electrically connected the second plate of the programming capacitor to the gate of the drive transistor.

3. The pixel circuit of claim 2, further comprising a third switch transistor connected between the second plate of the programming capacitor and a data voltage supply line that supplies the data voltage, wherein the third switch transistor is placed in an on state during the combined data programming and second threshold compensation phase to apply the date voltage to the second plate of the programming capacitor.

4. The pixel circuit of claim 3, further comprising a fourth switch transistor connected between an initialization voltage supply line that supplies an initialization voltage and the first terminal of the light emitting device, wherein the fourth switch transistor is placed in an on state to apply the initialization voltage to the first terminal of the light-emitting device and to a node (N1) corresponding to a connection of the second terminal of the drive transistor, the first plate of the programming capacitor, and the first plate of the storage capacitor.

5. The pixel circuit of claim 4, further comprising a fifth switch transistor that is connected between the node (N1) and the first terminal of the light-emitting device, wherein the fifth transistor is placed in an on state to electrically connect the first terminal of the light-emitting device to the node (N1).

6. The pixel circuit of claim 1, wherein at least one of the transistors is an indium gallium zinc oxide (IGZO) transistor.

7. The pixel circuit of claim 1, wherein the light-emitting device is one of an organic light-emitting diode, a micro light-emitting diode (LED), or a quantum dot LED.

8. A method of operating a pixel circuit for a display device comprising the steps of:

providing a pixel circuit comprising:

a drive transistor configured to control an amount of current to a light-emitting device during an emission phase depending upon a voltage applied to a gate of the drive transistor, the drive transistor having a first terminal and a second terminal with the first terminal being connected to a first voltage supply line;

a programming capacitor having a first plate connected to the first terminal of the drive transistor, and a second plate that is electrically connectable to the gate of the drive transistor;

a storage capacitor having a first plate connected to the second terminal of the drive transistor and a second plate connected to the gate of the drive transistor;

a light-emitting device having a first terminal that is electrically connectable to the second terminal of the drive transistor, and a second terminal connected to a second voltage supply line; and a first switch transistor connected between the gate of the drive transistor and the first voltage supply line;

performing a first threshold compensation phase to compensate a threshold voltage of the drive transistor comprising:

placing the first switch transistor in an on state, thereby diode connecting the drive transistor by electrically connecting the gate and the first terminal of the drive transistor through the first switch transistor; and electrically disconnecting the second terminal of the drive transistor from the first terminal of the light-emitting device;

wherein the threshold voltage of the drive transistor is stored at the storage capacitor and pre-charges the storage capacitor;

performing a combined data programming and second threshold compensation phase to program data and further compensate the threshold voltage of the drive transistor comprising:

electrically connecting the second plate of the programming capacitor to a data voltage supply line that supplies a data voltage, wherein the date voltage is applied to the second plate of the programming capacitor to store the data voltage; and storing the threshold voltage at the first plate of the programming capacitor while maintaining the first switch transistor in the on state to further perform threshold compensation of the threshold voltage of the drive transistor; and performing an emission phase during which light is emitted from the light-emitting device comprising electrically connecting the first terminal of the light-emitting device to the second terminal of the drive transistor and applying a driving voltage from the first voltage supply line to the light-emitting device through the drive transistor.

9. The method of operating of claim 8, wherein the pixel circuit further comprises a second switch transistor connected between the gate of the drive transistor and the second plate of the programming capacitor; and wherein the emission phase further comprises placing the second switch transistor in an on state to electrically connect the second plate of the programming capacitor to the gate of the drive transistor through the second switch transistor.

10. The method of operating of claim 9, wherein the pixel circuit further comprises a third switch transistor connected between the second plate of the programming capacitor and a data voltage supply line that supplies the data voltage; and wherein the combined data programming and second threshold compensation phase further comprises placing the third switch transistor in an on state to apply the date voltage to the second plate of the programming capacitor through the third switch transistor.

11. The method of operating of claim 8, further comprising performing an initialization phase to initialize voltages within the pixel circuit comprising the steps of:

electrically connecting the first terminal of the light-emitting device to an initialization voltage supply line that supplies an initialization voltage to initialize a voltage of the light-emitting device; and electrically connecting the initialization voltage supply line to a node (N1) corresponding to a connection of the first terminal of the drive transistor, the first plate of the programming capacitor, and the first plate of the storage capacitor, thereby applying the initialization voltage to the node (N1) to initialize a gate voltage of the drive transistor and voltages across the programming capacitor and the storage capacitor.

12. The method of operating of claim 11, wherein the initialization phase further comprises placing the first switch transistor in the on state to diode connect the drive transistor to electrically connect the gate of the drive transistor to the first voltage supply line through the first switch transistor.

13. The method of operating of claim 11, wherein the pixel circuit further comprises a second switch transistor connected between the initialization voltage supply line that supplies the initialization voltage and the first terminal of the light emitting device; and wherein each of the initialization phase, the first threshold compensation phase, and the combined data programming and second threshold compensation phase further comprises placing the second switch transistor in an on state to apply the initialization voltage to the first terminal of the light-emitting device through the second switch transistor.

14. The method of operating of claim 13, wherein the pixel circuit further comprises a third switch transistor connected between the node (N1) and the first terminal of the light-emitting device; and wherein the initialization phase further comprises placing the third switch transistor in an on state to electrically connect the node (N1) to the initialization voltage supply line through the second and third switch transistors.

15. The method of operating of claim 14, wherein the emission phase further comprises placing the third switch transistor in an on state to electrically connect the first terminal of the light-emitting device to the second terminal of the drive transistor.

16. The method of operating of claim 8, wherein at least one of the transistors is an indium gallium zinc oxide (IGZO) transistor.

17. The method of operating of claim 8, wherein the light-emitting device is one of an organic light-emitting diode, a micro light-emitting diode (LED), or a quantum dot LED.

* * * * *